US005784968A

United States Patent [19]

MacDonnell

[11] Patent Number: 5,784,968

[45] Date of Patent: Jul. 28, 1998

[54] LOCOMOTIVE TOP DECK COVER SUPPORT BRACKET

[75] Inventor: John Kenneth MacDonnell, Crete, Ill.

[73] Assignee: R. W. Mac Company, Crete, Ill.

[21] Appl. No.: 835,144

[22] Filed: Apr. 4, 1997

[51] Int. Cl.[6] ..... B61C 17/00

[52] U.S. Cl. ..... 105/26.05; 105/463.1; 49/148; 292/297; 16/82; 16/DIG. 17

[58] Field of Search ..... 105/26.05, 133, 105/140, 463.1; 49/148; 292/263, 289, 297, 298; 16/82, DIG. 17

[56] References Cited

U.S. PATENT DOCUMENTS

| | | | |
|---|---|---|---|
| 1,905,514 | 4/1933 | Shepard | 49/148 |
| 2,254,470 | 9/1941 | Blomberg | 150/26.05 |
| 2,370,237 | 2/1945 | Essl | 105/26.05 |
| 2,951,723 | 9/1960 | Bernhard | 16/DIG. 17 |
| 3,480,247 | 11/1969 | Waner | 16/82 |
| 5,367,826 | 11/1994 | Wu | 49/343 |
| 5,575,513 | 11/1996 | Tuttle | 16/82 |

*Primary Examiner*—S. Joseph Morano
*Attorney, Agent, or Firm*—Jack D. Nimz

[57] ABSTRACT

A locomotive engine top deck cover support apparatus for supporting the top deck cover of a locomotive engine in a selective position, has a ratchet member with a plurality of radially disposed ratchet teeth and a support arm pivotal between a fully raised and fully lowered position. The support arm supports a reciprocal pawl which is biased into engagement with the ratchet member. The ratchet engaging end of the pawl and the ratchet teeth are configured such that the forward side of the pawl is angled and is cammingly displaced by the angled rear sides of the ratchet teeth upon movement of the support arm toward its fully raised position to allow the support arm to be moved past the ratchet teeth in the direction of its fully raised position to any selective angular position, and the pawl bears against the radially extending forward sides of the ratchet teeth after it has been moved to the desired angular position to prevent movement of the support arm back toward its fully lowered position when the support arm is supporting a locomotive engine top deck cover.

7 Claims, 3 Drawing Sheets

LOCOMOTIVE TOP DECK COVER SUPPORT BRACKET

FIELD OF THE INVENTION

The present invention pertains to apparatus for supporting the top deck covers of locomotive engines in raised positions.

BACKGROUND OF THE INVENTION

Typical locomotive engines have four hinged covers at the top deck, at the top end of the engine. It is often necessary to hold the covers fully open, such as in order to gain access for the purposes of engine maintenance; and it is sometimes necessary to hold the covers only partially open, such as for allowing ventilation of moisture from the engine compartment as well as maintenance access.

Such locomotive top deck covers are often quite heavy, making it difficult to hold the covers open against the force of gravity particularly while attempting to simultaneously work on the locomotive engine which often requires usage of heavy tools. Also, it is difficult to hold such locomotive engine covers open for extended periods of time. Workers therefore frequently propped the covers open with whatever object was available, which occasionally resulted in accidents as a result of the objects becoming displaced and the locomotive engine cover falling closed. Accordingly, there has long been recognized the need for an apparatus to safely support such locomotive engine covers in an open position.

A commonly employed apparatus for supporting locomotive top deck covers in an open position has a disk member with a plurality of radially spaced holes. The disk member is mounted in a stationary position to the top deck area of the locomotive engine and extends perpendicularly inwardly from the top deck area of the locomotive engine. An axle extends through the disk member and is rigidly supported by the disk member. A support arm is pivotally mounted to the axle for movement between a raised position and a lowered position. The support arm is slidable along the axle, and spring biased into abutment with the disk member. The support arm has a transverse pin which is receivable in any selective one of the radially spaced holes in the disk member.

The support arm is pivotable to any desired angular position by pushing the support arm against the spring biasing force and away from the disk member, so that its transverse pin is moved out of contact with the disk member. The support arm is locked at a selective stationary position, at which it is desired to hold the locomotive engine cover open at, by then moving the support arm to the desired angular position at which its transverse pin is in alignment with one of the holes in the disk member. Upon releasing the support arm after moving it into this aligned position, the spring biasing forces the support arm against the disk member whereby the transverse pin is received in the selective hole with which it is aligned, which locks the support bar in a stationary position and prevents further displacement of the support arm. Thereby, the locomotive engine cover may then be rested on the locked support bar to maintain the locomotive engine cover in the selected open position.

This apparatus suffers numerous shortcomings, a particular one of which is that accidental bumping into the support arm may displace the transverse pin of the support arm from the hole in the disk member, thereby allowing the support bar, and the locomotive engine cover supported by the support bar, to fall down. Another shortcoming associated with the aforementioned commonly employed apparatus is that the entire force of the large locomotive engine covers is borne as a shear force by the small transverse pin. The transverse pin is therefore subject to breaking and/or shearing due to large weight locomotive engine covers and/or prolonged usage.

Therefore, there is a need for an improved locomotive top end cover stop which overcomes each of the aforementioned shortcomings associated with currently employed apparatus.

SUMMARY OF THE INVENTION

In accordance with the present invention, a locomotive engine top deck support bracket is provided for maintaining a locomotive engine top deck cover in an open position, which overcomes the shortcomings associated with current apparatus. The locomotive engine top deck support bracket comprises a ratchet member mountable to the top deck area of the locomotive engine and having a plurality of radially disposed ratchet teeth with respective forward and rear sides. An axle extends through the ratchet member and is fixedly mounted thereto. An elongated support arm having a pivot end and an opposite cover supporting end has its pivot end pivotally mounted to the axle for movement of the support arm between a fully raised position and a fully lowered position. A pawl is mounted to the support arm for linear displacement between an engaged position in engagement with the ratchet member and a disengaged position out of engagement with the ratchet member. The pawl is biased toward its engaged position and has a ratchet member engaging end defined by an angled forward camming surface and a rear stopping surface. The angled forward camming surface of the pawl is cooperable with the rear sides of each of the plurality of ratchet teeth to effect camming displacement of said pawl toward its disengaged position upon pushing the support arm toward its fully raised position, to allow the support arm to be moved past the ratchet teeth in the direction of its fully raised position to any selective angular position. The rear stopping surface of the pawl cooperates with the forward sides of each of the plurality of ratchet teeth to prevent movement of the support arm past the ratchet teeth toward its fully lowered position. Accordingly, after being moved past a selective number of ratchet teeth to a selective angular position, the engaging end of the pawl bears against the forward side of the last ratchet tooth it was moved past, thereby securely maintaining the support bar in a selective position for supporting the locomotive engine cover on the cover supporting end of the support arm. When it is desired to move the support arm past the ratchet teeth toward its fully lowered position, the pawl is manually displaced to its disengaged position and held in its displaced position to allow unimpeded movement of the support arm past the ratchet teeth toward its fully lowered position.

In accordance with another aspect of the present invention, the support arm has a slot therein, defined by a proximal end and a distal end, and the pawl has a transverse pin which extends into the slot. The abutment of the transverse pin against the distal end of said slot defines the limit of movement of the pawl away from the ratchet member, and the transverse pin remains spaced from the proximal end of the slot throughout operation of the apparatus.

BRIEF DESCRIPTION OF THE DRAWINGS

In the drawings, wherein like elements are referenced alike.

DETAILED DESCRIPTION OF THE PREFERRED EMBODIMENT(S)

Figure 1:
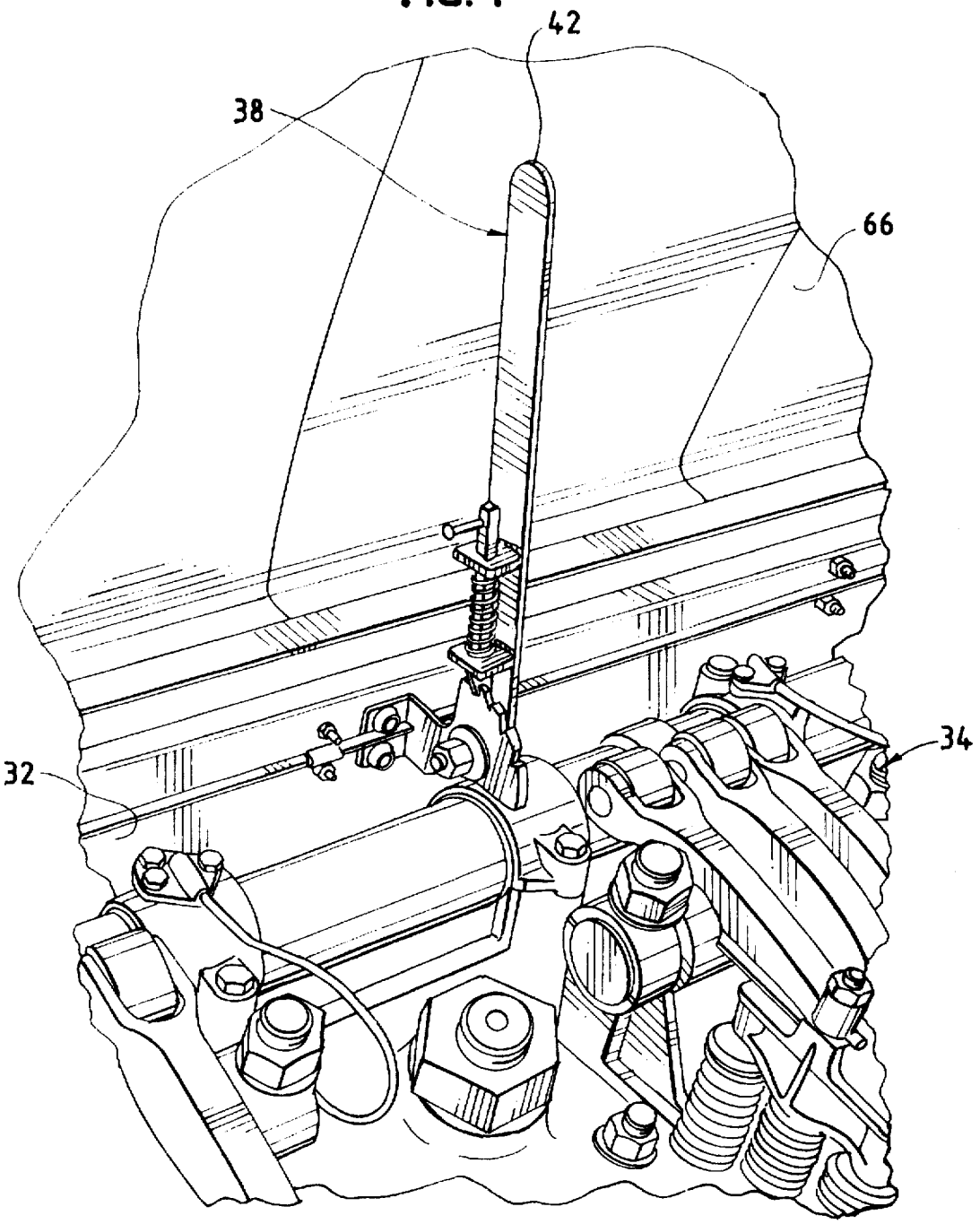
FIG. 1 is a perspective view of a locomotive engine top deck cover support bracket embodying various features of the present invention, and shown mounted to a locomotive engine top deck area and supporting a locomotive engine cover.
Figure 2:
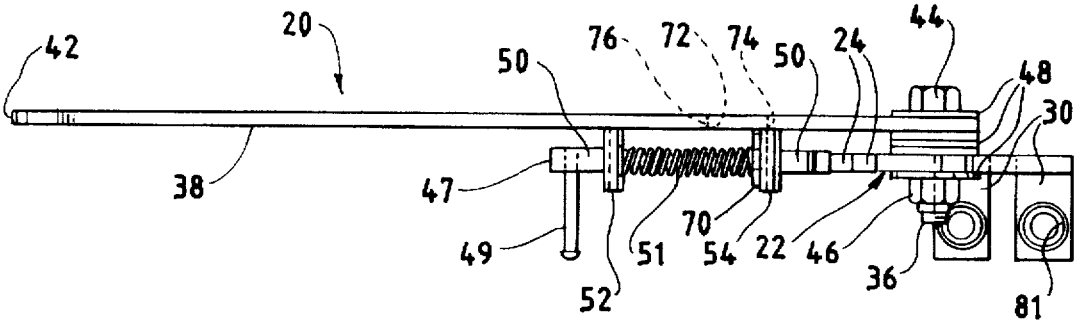
FIG. 2 is a front elevational view of the locomotive engine top deck cover support bracket of FIG. 1.
Figure 3:
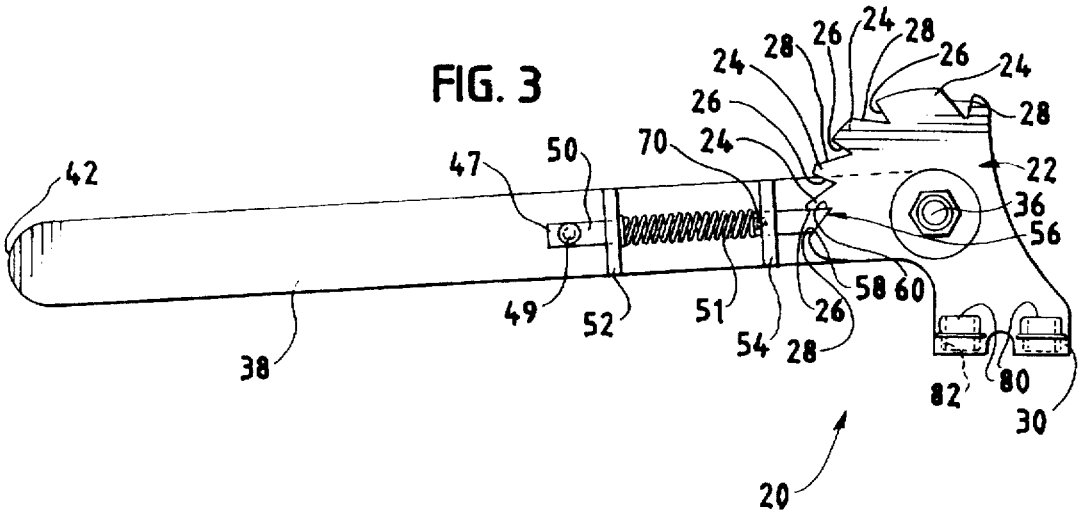
FIG. 3 is a side elevational view of the locomotive top deck support bracket of FIG. 1.
Figure 4:
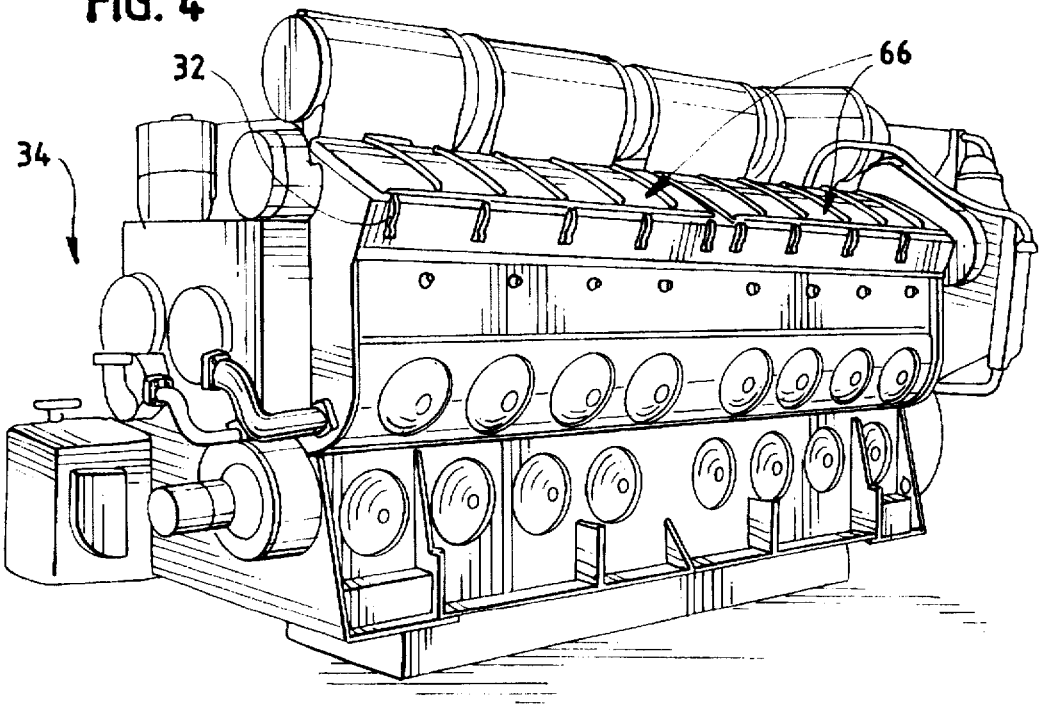
FIG. 4 is a left, front elevational view of a locomotive engine, illustrating a pair of the four covers at the top deck of the engine in their closed positions.
Figure 5:
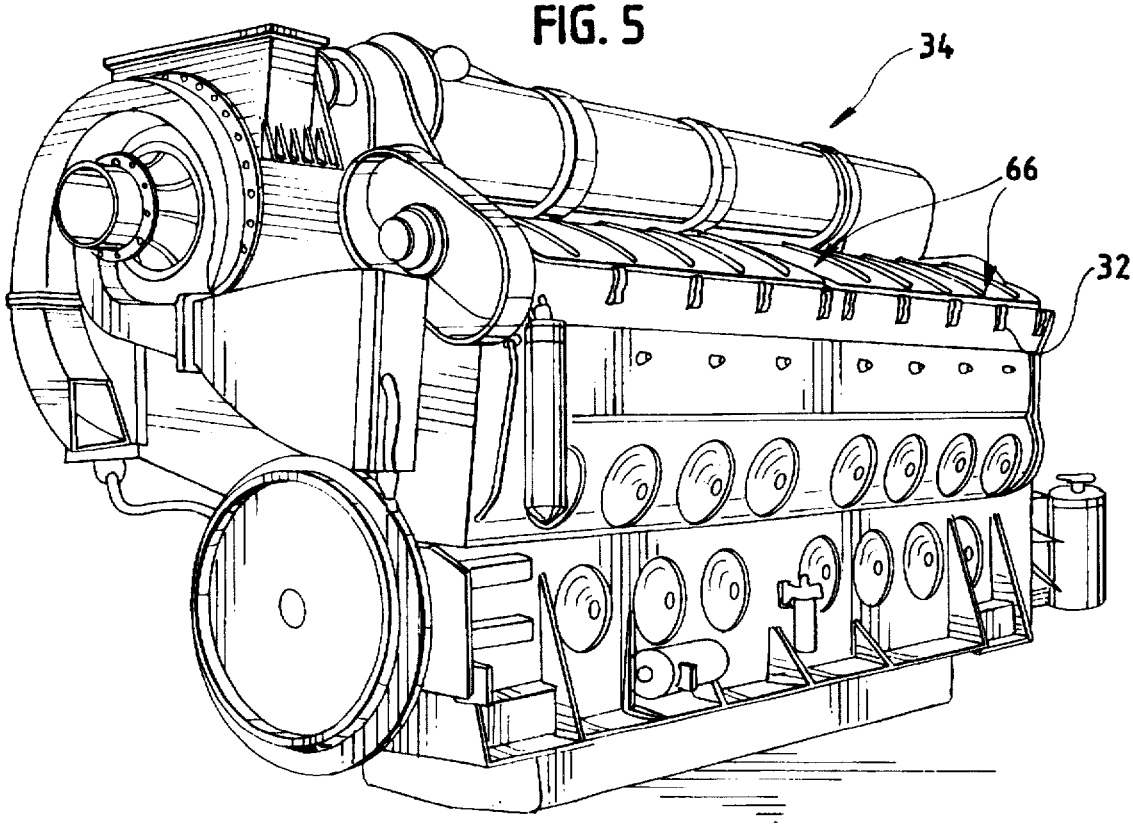
FIG. 5 is a right, rear elevational view of the locomotive engine of FIG. 4, illustrating the other pair of the four top deck covers of the engine in their closed positions.

A locomotive engine top deck cover support apparatus embodying various features of the present invention is illustrated in FIGS. 1–3 and referred to generally by reference numeral 20.

The locomotive engine top deck cover support apparatus 20 has a ratchet member 22 having a plurality of radially disposed ratchet teeth 24 each having respective forward sides 26 and rear sides 28. The ratchet member 22 also has a pair of integral mounting legs 30 which extend perpendicularly with respect to the ratchet tooth portion of the ratchet member 22, such that when the mounting legs 30 are mounted flush to the top deck wall 32 of a locomotive engine 34, the ratchet tooth portion of the ratchet member 20 extends substantially perpendicularly inwardly from the locomotive top deck wall 32, as illustrated in FIG. 1.

A bolt, which serves as an axle 36, extends through the ratchet member 22. An elongated support arm 38 has a pivot end 40 and an opposite cover supporting end 42. The pivot end 40 of the support arm 38 is pivotally mounted on the axle 36 and retained on the axle 36, to allow angular movement of the support arm 38 relative to the ratchet member 22 between fully raised and fully lowered positions. In the illustrated embodiment, a bolt serves as the axle 36, with the bolt head 44 and nut 46 maintaining the ratchet member 22 and support arm 38 on the axle 36. A plurality of washers 48 are disposed between the support arm 38 and the ratchet member 22 to maintain a small spacing therebetween for reduced frictional resistance to angular movement of the support arm 38 relative to the ratchet member 22.

A pawl 50 is mounted to the support arm 38 in a manner which allows for linear displacement of the pawl 50 between an engaged position, in which the pawl 50 is in engagement with the ratchet member 22 (as illustrated in FIGS. 1–3), and a disengaged position in which the pawl 50 is out of engagement with the ratchet member 22. A spring 51 biases the pawl 50 into engagement with the ratchet member 22.

The pawl has a ratchet member engaging end 56 defined by an angled forward camming surface 58 and a rear stopping surface 60, and an opposite lifting end 47. The angled forward camming surface 58 of the pawl 50 is cooperable with the angled rear sides 28 of each of the plurality of ratchet teeth 24 to effect camming displacement of the pawl 50 toward its disengaged position upon application of force to the support arm 38 in the direction of its fully raised position. That is, as the support arm 38 is moved in the direction of its fully raised position from a lower position, upon the pawl encountering a ratchet tooth 24, its angled forward camming surface 58 slides against the rear side 28 of the ratchet tooth 24, which forces the pawl 50 toward its disengaged position to allow the pawl 50 to slide over the ratchet tooth 24. Accordingly, to move the support arm 38 from a lower position to a more raised position, an operator needs to merely push the support arm 38 toward its fully raised position. Hence, it is not necessary to manually disengage the pawl 50 from the ratchet member 22 in order to swing the support arm in the direction of its fully raised position, since the pawl 50 will slide over each of the ratchet teeth 24 when the support arm 38 is moved in the direction of its fully raised position.

After the support arm 38 has been moved past a number of ratchet teeth 24 to the desired angular position at which it is desired to support the locomotive engine top deck cover 66, the engagement of the pawl 50 with the ratchet member 22 prevents the support arm 38 from returning back downwardly toward its fully lowered position. That is, with the locomotive engine cover 66 bearing against the support arm 38 and exerting a force on the support arm 38 in the direction of its fully lowered position, the spring 51 biases the pawl 50 into engagement with the ratchet member 22, and the rear stopping surface 60 of the pawl bears against the rear side 28 of the first ratchet tooth 24 it encounters, to prevent movement of the pawl 50 past the ratchet teeth 24 in this direction. Thereby, the support arm 38 is maintained at any selective angular position, for supporting the locomotive engine top deck cover 66 at any desired open position.

In order to move the support arm 38 back toward its fully lowered position, and past the ratchet teeth 24, the pawl 50 is manually lifted against the biasing force of the spring 51 to its disengaged position, at which the engaging end 56 of the pawl 50 is spaced from the ratchet member 22. A transverse lifting pin 49 is preferably provided near the lifting end 47 and extends in the opposite direction of the support arm 38 by which the pawl 50 may be readily lifted to its disengaged position spaced from the ratchet member 22. With the engaging end 56 of the pawl 50 maintained spaced from the ratchet member 22, the support arm 38 is freely pivotable in either direction to any position. Upon release of the pawl 50, the spring 51 biases the pawl 50 back into engagement with the ratchet member 22, and the abutment of the rear stopping surface 60 of the pawl against the rear side 28 of the first ratchet tooth 24 it encounters prevents movement of the pawl 50 toward its fully lowered position.

Accordingly, it will now be appreciated that the apparatus 20 of the present invention overcomes the problem of the prior art of the engine cover stop becoming disengaged upon being accidentally knocked from its side, allowing the locomotive engine cover to unexpectedly drop. The apparatus 20 of the present invention also overcomes the problem of the entire force of the weight of the locomotive engine cover 66 being borne by a small pin, as in the prior art. Finally, it will be appreciated that the apparatus 20 of the present invention overcomes these problems in a manner which allows for inexpensive manufacture and more simple use than prior art locomotive engine cover stop apparatus.

It will also now be appreciated that the apparatus 20 of the present invention provides immediate and automatic engagement of the support arm 38 after it is moved to its desired support position. This provides significantly improved safety over prior art locomotive engine cover stops, in that an operator does not need to securely insert a pin after the support arm has been raised to the desired support position; rather, in the apparatus 20 of the present invention the support arm automatically secures itself. This eliminates the potential for accidents due to operator error.

In the illustrated embodiment, the pawl SO extends through each of a pair of spaced lugs 52 and 54 which are integral with the support arm 38, whereby the lugs 52 and 54 support the pawl 50 and define the path of linear reciprocation of the pawl 50 between its engaged and disengaged positions. The pawl 50 has a transverse pin 70 affixed thereto which extends from the pawl 50 in the direction of the support arm 38, and which is received in a slot 72 in the support arm 38. The slot 72 has a proximal end 74 and a distal end 76. The slot 72 and transverse pin 70 are located and proportioned such that the transverse pin 70 abuts the distal end 76 of the slot 72 to define the limit of movement of the pawl 50 away from the ratchet member, and such that the pin 70 remains spaced from the proximal end 74 of the slot 72 when the pawl 50 is in engagement with the ratchet member 22.

In order to insure that the transverse pin 70 remains extending into the slot 72 in the support arm 38, and to insure that the engaging end 56 of the pawl 50 is maintained in the proper orientation, the pawl 50 is preferably rectangular or square and passes through complementary rectangular or square apertures in the lugs 52 and 54 to maintain the orientation of the pawl 50 and prevent it from turning about its axis. To minimize manufacturing costs, the same pin 70 used to limit movement of the pawl 50 at its fully disengaged position is also used to engage the pawl 50 to the spring 51 for biasing of the pawl 50 toward its engaged position.

In accordance with one aspect of the present invention, a pair of nuts 80 are welded or otherwise permanently affixed to the ratchet member in alignment with respective apertures 83 formed in the mounting legs 30 of the ratchet member 22. This greatly facilitates easy mounting of the apparatus 20 to the locomotive wall 32. The nuts 80 preferably have a plastic lining 82 which engages the mounting bolts passed therethrough to prevent the mounting bolts used to mount the apparatus 20 from becoming loosened over time due to the excessive vibrations typically realized in a locomotive environment.

In the illustrated and preferred embodiment, the forward sides 26 of the ratchet teeth 22 extend radially with respect to the center of the axle 36 which defines the pivot axis of the support arm 38. The rear sides 28 of the ratchet teeth 24 extend at an angle of approximately 50° with respect to the forward sides 26 of the ratchet teeth 24, and the angled forward camming surface 58 of the engaging end 56 of the pawl 50 extends at an angle of approximately 50° with respect to its rear stopping surface 60.

In accordance with another aspect of the present invention, the ratchet teeth 22 are preferably formed by laser cutting, followed by tumbling to remove any sharp edges. It has been found that utilization of punching operations to form the ratchet teeth 24 results in tearing of the material and unacceptably sharp edges on the down side of the material on the ratchet teeth after being punched. While laser cutting of the ratchet teeth 24 has also been found to produce sharp edges, it has been found that laser cutting of the ratchet teeth followed by tumbling together of a plurality of cut ratchet members provides acceptably smooth and rounded edges.

While the invention is described herein by way of preferred and illustrated embodiments, many variations and modifications will be readily apparent to those skilled in the art to which this invention pertains, and all such variations and modifications are considered to be within the scope and spirit of the invention as set forth in the accompanying claims.

What is claimed is:

1. A locomotive engine top deck cover support apparatus for maintaining a locomotive top deck cover in an open position, the apparatus comprising:

a ratchet member mountable to said locomotive engine and having a plurality of radially disposed ratchet teeth with respective forward and rear sides;

an axle extending through said ratchet member;

an elongated support arm having a pivot end and an opposite cover supporting end, the pivot end being pivotally mounted to said axle for movement of said support arm between a fully raised position and a fully lowered position;

a pawl mounted to said support arm for linear displacement between an engaged position in engagement with said ratchet member and a disengaged position out of engagement with said ratchet member, said pawl being biased toward said engaged position and having a ratchet member engaging end defined by an angled forward camming surface and a rear stopping surface;

said angled forward camming surface of said pawl being cooperable with the rear sides of each of said plurality of ratchet teeth to effect camming displacement of said pawl toward said disengaged position upon application of force to said support arm moving it toward its fully raised position, to allow angular displacement of said support arm past said ratchet teeth to any selective angular position;

said rear stopping surface of said pawl being cooperable with the forward sides of each of said plurality of ratchet teeth to prevent movement of the support arm past said ratchet teeth toward its fully lowered position, thereby maintaining said support bar in said selective position for supporting said locomotive engine top deck cover on said cover supporting end of said support arm; and said pawl being manually displaceable to its disengaged position to allow movement of said support arm past said ratchet teeth toward its fully lowered position.

2. An apparatus in accordance with claim 1 in which said support arm includes a slot therein having a proximal end and a distal end, and said pawl has a transverse pin extending into said slot, with abutment of said transverse pin against said distal end of said slot defining said disengaged position, and said transverse pin remaining spaced from said proximal end of said slot throughout operation of said apparatus.

3. An apparatus in accordance with claim 2 further including a pair of pawl guides mounted to said support arm and disposed in proximity to respective opposed ends of said slot for supporting and guiding the pawl through its linear displacements.

4. An apparatus in accordance with claim 1 in which said ratchet member has a mounting leg portion extending perpendicularly from the remainder of said ratchet member which is mountable to a wall of said locomotive engine to support said ratchet teeth in a vertical plane and extending perpendicularly with respect to said locomotive engine wall.

5. An apparatus in accordance with claim 1 in which the ratchet teeth are formed by laser cutting sharp corners followed by tumbling a plurality of said ratchet members together to dull the sharp corners.

6. A locomotive engine top deck cover support apparatus for supporting a locomotive engine top deck cover in a selective position, the locomotive engine having a wall, the apparatus comprising:

a ratchet member having a plurality of radially disposed ratchet teeth with respective forward and rear sides, and having an integral mounting leg portion extending perpendicularly from the remainder of said ratchet member which mounting leg portion is mountable to said locomotive engine wall to support said ratchet teeth in a substantially vertical plane extending perpendicularly inwardly with respect to said locomotive engine wall;

an axle extending through said ratchet member and defining a pivot axis;

an elongated support arm having a pivot end and an opposite cover supporting end, the pivot end being pivotally mounted to said axle for angular movement of said support arm about said axle pivot axis between a fully raised position and a fully lowered position, and said support arm having a slot therein defining a proximal slot end and a distal slot end;

a pawl mounted to said support arm for linear displacement between an engaged position in engagement with said ratchet member and a disengaged position out of engagement with said ratchet member, said pawl extending substantially radially with respect to the pivot axis and having a ratchet member engaging end defined by a rear stopping surface and a forward camming surface which extends at an acute angle with respect to the rear stopping surface;

a transverse pin mounted to said pawl and extending into said support arm slot, with the pawl being in its disengaged position when the transverse pin abuts the distal end of the slot, and said transverse pin remaining spaced from said proximal end of said slot when the pawl is in said engaged position;

a spring operatively coupled to said pawl and said support arm to bias said pawl to its engaged position;

said angled forward camming surface of said pawl engaging end being cooperable with the rear sides of each of said plurality of ratchet teeth to effect camming displacement of said pawl toward said disengaged position upon application of force to said support arm moving it toward its fully raised position, to allow angular displacement of said support arm past said ratchet teeth to any selective angular position when moving the support arm toward its fully raised position;

said rear stopping surface of said pawl engaging end being cooperable with the forward sides of each of said plurality of ratchet teeth to prevent movement of the support arm past said ratchet teeth toward its fully lowered position, thereby maintaining said support bar in said selective angular position for supporting said locomotive engine top deck cover on said cover supporting end of said support arm; and said pawl being manually displaceable to its disengaged position to allow movement of said support arm past said ratchet teeth toward its fully lowered position.

7. A locomotive engine top deck cover support apparatus in accordance with claim 6 in which both the rear stopping surface of the pawl engaging end and the forward side of the ratchet teeth each extend substantially radially from the pivot axis, and both the angled forward camming surface of the pawl engaging end and the rear side of the ratchet teeth each extend at an angle of approximately 50° off of radial.

* * * * *